US006895784B2

(12) United States Patent
Hofmann

(10) Patent No.: US 6,895,784 B2
(45) Date of Patent: May 24, 2005

(54) DEVICE FOR MACHINE KNITTING

(75) Inventor: Ulrich Hofmann, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/470,132

(22) PCT Filed: Mar. 12, 2002

(86) PCT No.: PCT/DE02/00866

§ 371 (c)(1),
(2), (4) Date: Jul. 23, 2003

(87) PCT Pub. No.: WO02/072936

PCT Pub. Date: Sep. 19, 2002

(65) Prior Publication Data

US 2004/0093910 A1 May 20, 2004

(30) Foreign Application Priority Data

Mar. 14, 2001 (DE) ..... 101 12 277
Nov. 1, 2001 (DE) ..... 101 52 856

(51) Int. Cl.[7] ..... D04B 35/06
(52) U.S. Cl. ..... 66/120
(58) Field of Search ..... 66/116–123, 62, 66/13, 90, 8

(56) References Cited

U.S. PATENT DOCUMENTS 1,877,503 A 9/1932 Augustin
4,197,721 A * 4/1980 Hofmann et al. ..... 66/19
4,423,606 A * 1/1984 Hofmann ..... 66/13

FOREIGN PATENT DOCUMENTS

DE 26 47 185 A 5/1978
DE 29 50 147 A1 7/1980
DE 29 08 022 A 9/1980
DE 29 09 963 A 9/1980

* cited by examiner

*Primary Examiner*—Danny Worrell
(74) *Attorney, Agent, or Firm*—Michael J. Striker

(57) ABSTRACT

A device for machine knitting with at least one continuous yarn, in which the yarn, by a hook part of a knitting needle, is passed in a loop through a previously formed loop and forms a new loop, in which the knitting needle, below a needle hook, has a slot into which a downward-oriented transfer hook movable in a vertical direction can be introduced, and the transfer hook is introducable into the slot by a simultaneously controllable transverse motion.

12 Claims, 5 Drawing Sheets

Fig.21
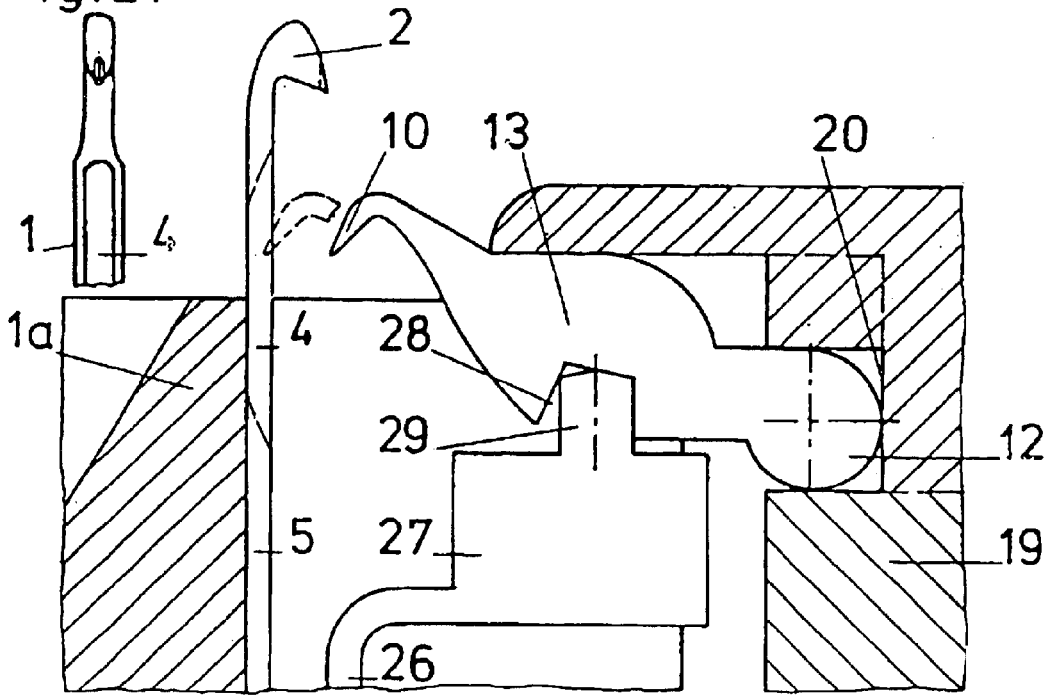
Fig.20
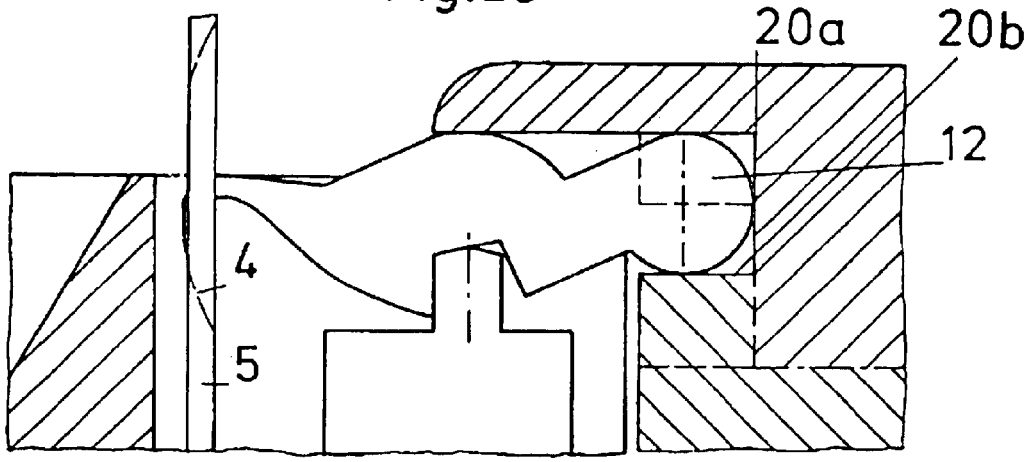
Fig.22
Fig.23-25
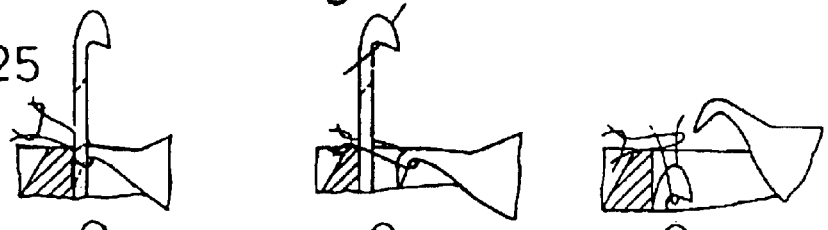
Fig.26-28
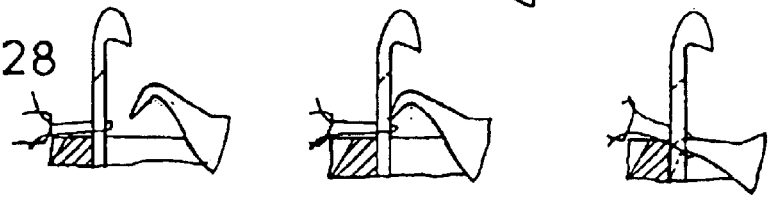

DEVICE FOR MACHINE KNITTING

BACKGROUND OF THE INVENTION

The invention relates to a device for machine knitting with at least one continuous yarn, in which the yarn, by means of the hook part of a knitting needle, is passed in a loop through the previously formed loop and forms a new loop, in which the knitting needle, below the needle hook, has a slot into which a downward-oriented transfer hook movable in the vertical direction can be introduced.

In all previously employed methods for loop formation, the last-formed loop is held by a hook, embodied as the head of the needle, which then as the needle is advanced is brought into a shunt position. From there, via a yarn newly caught in the needle hook, upon retraction of the needle by means of shunt repositioning, it is brought over the closed hook and after the new loop has been drawn through the old loop is cast off over the latter. Hence the needle hook has two tasks: to hold the last loop and thus the knitted good formed until that point and to catch a new yarn and fashion it into a loop.

The use of the device for loop formation depends decisively on being able to assure certainty when the transfer hook plunges into the slot of the needle cheek. It is already an advantage that the needle and the transfer hook have the same shank thickness, which for relatively coarse pitches provides adequate certainty that the transfer hook, in its reverse motion, will enter the needle cheek. With very fine pitches, the lateral play in the needle channels and deviations in the lateral straightness of the loop formation elements can cause the transfer hook to strike the side wall of the needle slot instead of getting into the slot. In warp knitting machines this danger is even greater, since the loop formation takes place at a greater distance above the upper edge of the bar, so deviations in the lateral straightness can have an exaggerated effect.

From German Published, Examined Patent Application DE-AS 26 47 185, a method for machine knitting with at least one continuous yarn is known in which the yarn is passed in a loop through the previously formed loop and forms a new loop that is then held tightly, essentially in the same plane as the previously formed loop, until the next yarn caught, at the onset of loop formation, reaches the region of loop formation.

From German Patent Disclosure DE 29 50 147 A1, a knitting machine that has needles without latches is also known, in which perpendicular to the needle cylinder axis, relatively long shank parts are disposed as selector elements in radial slots and can be moved transversely and pivotably to the needle by control devices.

From German Patent DE 29 09 963 C2, a method and a device for machine knitting are known in which the needles, on the front side of the needle shank, each have an auxiliary part, which is guided like the needle and is controlled in its longitudinal direction and which widens the loop to be cast off and holds it until the new loop is drawn through.

In all the conventional knitting methods, a widening process is necessary, which is accomplished upon advancement of the needle by the rise from the neck to the cheek. The needle cheek at the same time serves to support the latch, or in compound needles, it serves to receive and guide the closing element.

In the known latch needle, the yarn must overcome a plurality of sliding resistances. First because of the rise of the needle cheek, then along the latch that is open at the rear, and finally upon retraction of the needle the rise to the hook and the widening via the latch spoon. In the compound needle it is problematic that the closing element has to disappear in the needle cheek, yet in the closing position is supposed to cover the hook. This puts limits on precision embodiments.

SUMMARY OF THE INVENTION

The object of the invention is to provide a device for knitting or loop formation that simply and with certainty makes smaller loop heights possible than in all the methods employed until now.

The inventions exhibit two different principles of embodiment. With them, in addition to the advantages resulting from how the object is attained, it is achieved that the needle strokes are extremely short, and no sliding resistances occur in the longitudinal motion of the needles. The knitted article and the loop pattern associated with it can be produced with substantially greater uniformity. Moreover, compact components can be used. As a result, extremely precise embodiments are possible. The pivoting outward of the transfer hook that is effective when turned around promotes casting off of loops and yarn feeding into the needle hook. Because the components are simpler, the service life is longer. All this makes great economy possible and keeps production costs low.

One embodiment of the invention pertains to design characteristics of the loop forming elements and the controlled inward motion of the transfer hook by means of a slide rail mounted on the needle cam.

Another embodiment of the invention serves the purpose of designing and centrally guiding the transfer hook.

The further features of the invention provide for assurance in grasping the loop from the needle cheek to the transfer hook. With it, the tolerances that exist in textile machines in the needle guides are meant to be obviated. These tolerances are unavoidable not only in the radial direction, for instance in circular knitting machines from the needle bottom to the inner face of the cylinder cam parts and laterally in the needle channels and have an even more disadvantageous effect, the finer the needles. Thus both demands for equalizing tolerance in needle guidance, both in the lateral direction and transversely to it, are met. The relative motion of the transfer hook to the needle in warp knitting machines is also simplified.

The further embodiments of the invention also enables compensation for tolerances in the transverse direction of the loop forming elements. It also offers an alternative to the central guidance of the transfer hook.

The further feature of the invention pertain to various variants of the transfer hook in terms of hook control.

Still the further embodiments of the invention is suitable for warp knitting machines, because the functions of the needle cylinder in the form of needle guidance and casting off can be taken over by drop wires.

BRIEF DESCRIPTION OF THE DRAWINGS

FIGS. 20–28, loop formation with a further version of the transfer hook.

DESCRIPTION OF THE PREFERRED EMBODIMENTS

In FIGS. 1–4, the course of motion of the front region of the loop forming elements is shown. The embodiment at the rear—not visible because of the 10× enlargement—is equivalent to those of FIGS. 5 and 8. Because of the resilient pressing of the two loop forming elements, it also allows a transverse motion of the transfer hook on the order of magnitude of its projection below the support plane, without requiring that special control parts be provided in the needle cam. Thus the cheek rise 3 extending beyond the height of the needle hook 2 and the projection of the transfer hook toward its bearing face are omitted. The loop height can be made smaller by that amount.

Figures 1, 2, 3, 4:
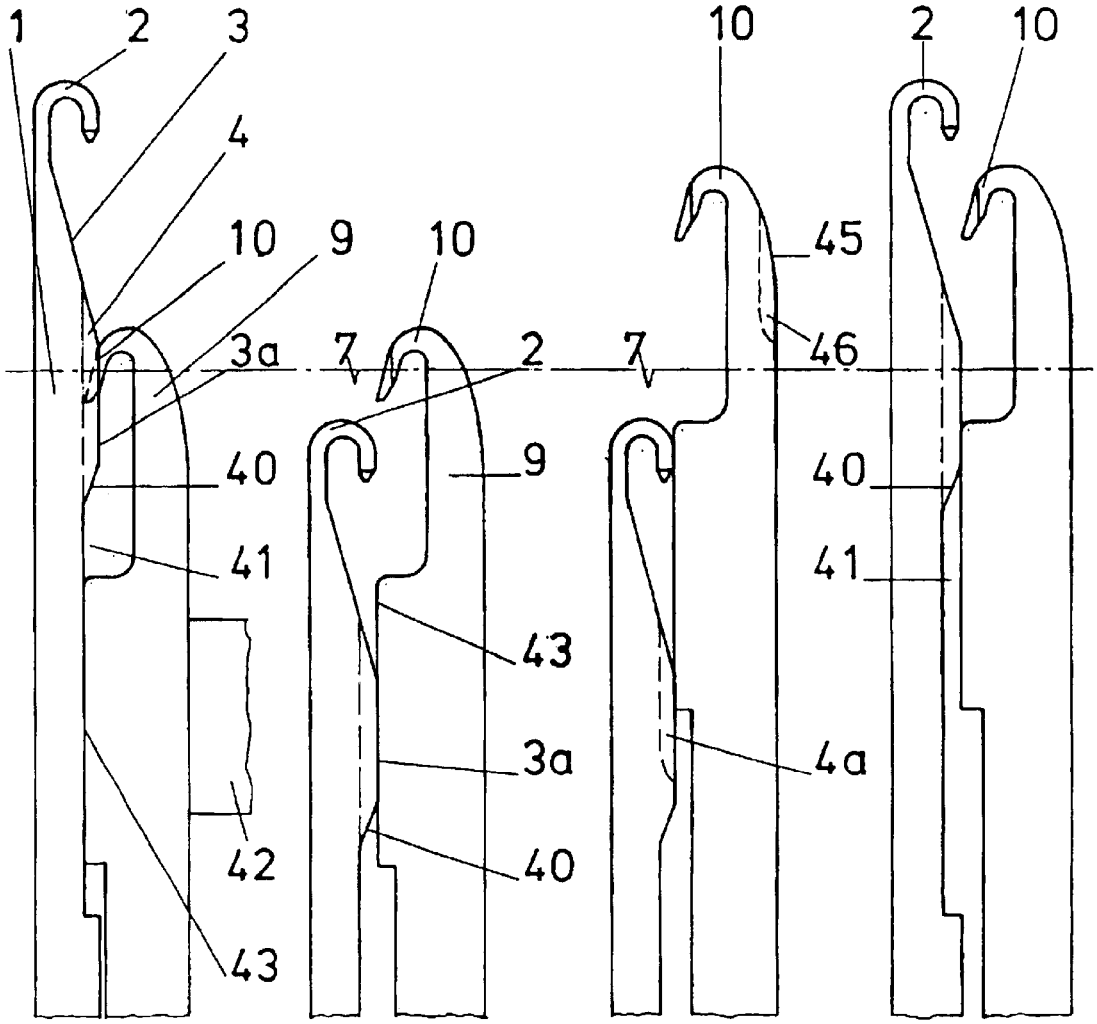
FIGS. 1–4, the basic illustration of the sequence of motion between the needle hook and the transversely movable transfer hook for minimal loop heights.

FIG. 1 shows the basic position. Above the knockover edge 7, shown in dot-dashed lines, the needle hook 2 is in the tuck position for receiving a new yarn. The front bearing face 43 of the transfer hook shank 9 is in the recess 41 behind the needle cheek 3*a*, so that the transfer hook 10 is located in the needle slot 4 and clears the most recently formed loop. The needle hook 1 is aligned with the height of the cheek 3*a*, and there is no projection of the transfer hook part 9 below the support plane. This is an important advantage in manufacturing the transfer hook part.

In FIG. 2, the needle hook 2 has moved backward into the position for drawing the new loop through the old loop. Because of the upper edge of its front bearing face 43 of the transfer hook 10, the transfer hook has moved away from the needle hook and has moved past it as a result of the slide face 40.

From FIG. 3 it can be seen that in the ensuing forward motion of the transfer hook, its outward position is preserved; also in this drawing, a noucat-like concavity 46 is provided on the back 45 of the transfer hook 10; this concavity serves the purpose of central guidance of the transfer hook 10 in the wider cylinder channel of the region for drawing the new loop through the old loop. Moreover, instead of the slot 4 of the needle 1 that is continuous as far as the recess 41 (FIG. 1), a channel that is open at the top or a noucat-like concavity 4*a* can be provided.

In FIG. 4, the needle hook has moved forward again in the outward position of the transfer hook.

It is also possible for the shank 9 of the transfer hook 10 (without a spring part) to be embodiment solidly. The outward motion of the transfer hook 10 is then effected by the slide face 40, while the inward motion is effected by a small slide rail 42, provided at an appropriate point in the needle cam, that acts on the shank 9 in its backward motion (FIG. 1).

Figure 5:
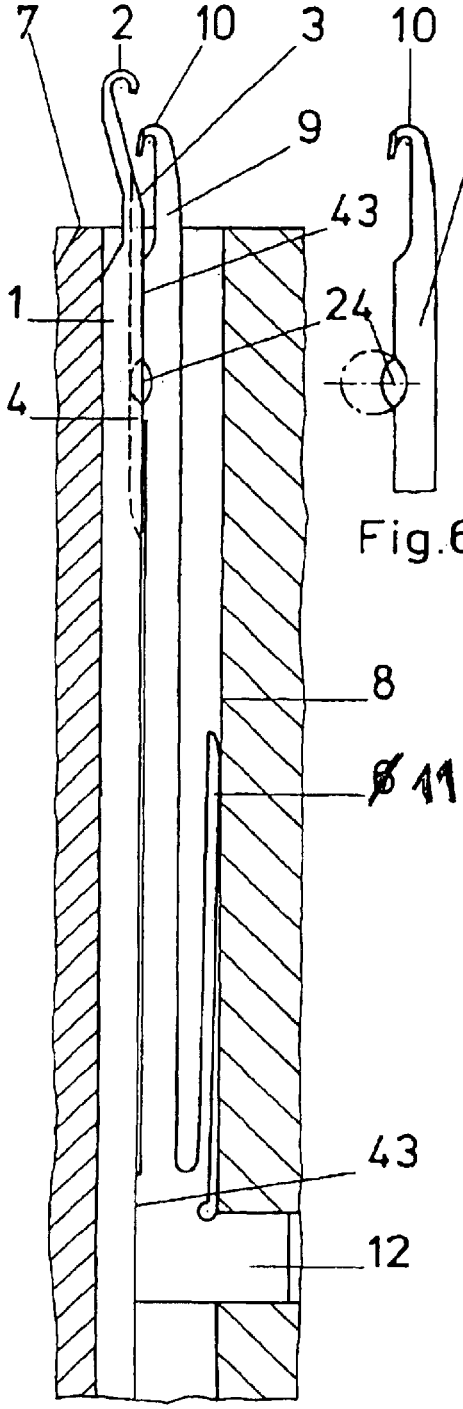
FIG. 5, a version for circular knitting machines without transverse motion of the transfer hook.

FIG. 5 shows the device in its embodiment for circular knitting machines without transverse motion of the transfer hook 10. The shank 9 of the transfer hook 10, given a full shank thickness of the needle 1, 2, 3, is guided in the needle channel. Two flat bearing faces 43 of the transfer hook 10 are provided on the upper edge of the needle, and between them a small recess (seesaw) assures the defined base, in the figurative extension of which the transfer hook 10 is disposed, shifted downward by the depth of penetration into the needle cheek 3*a*. The shank 9 of the transfer hook 10, above its control butt 12, has a spring part 11, so that after the needle cam is attached, the inside face 8 of the cam presses the shank 9 of the transfer hook 10 against the needle shank 1 and presses the latter against the bottom of the needle channel. A small projection of the transfer hook 10 below the shank support suffices to assure that the transfer hook in the slot 4 in the needle cheek 3*a* will engage the loop located over it. The control butt, which is provided in the rear region of the needle shank 1 and is guided in a second cam track, cannot be seen.

A latch 24 is provided on the shaft 9 of the transfer hook 10, specifically on the bearing face 43. It slides in the slot 4 of the needle cheek 3*a* and assures the central guidance of the transfer hook 10 relative to the needle 2.

Figure 6:
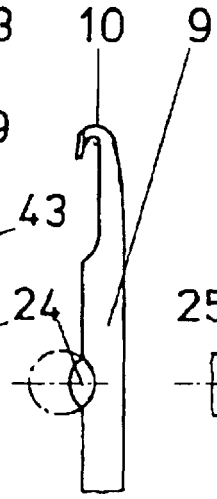
FIGS. 6 and 7, the enlarged front view of the guide latch.
Figure 7:
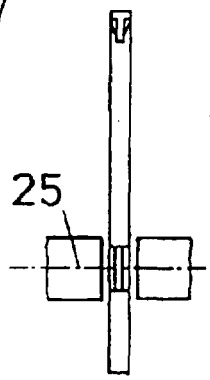

In FIG. 6, the latch 24 in the shank 9 of the transfer hook 10 is shown enlarged. It is formed by providing that two aligned punches 25 (FIG. 7) are placed on both sides of the front bearing face of the shank 9 in such a way that upon compression, a pea-shaped sector of a circle (latch 24) is pressed out in the middle on the underside of the support. The resultant latch 24 slides in the needle groove 4 of the cheek 3*a* and assures the central guidance of the transfer hook 10 relative to the needle 2.

Figure 8:
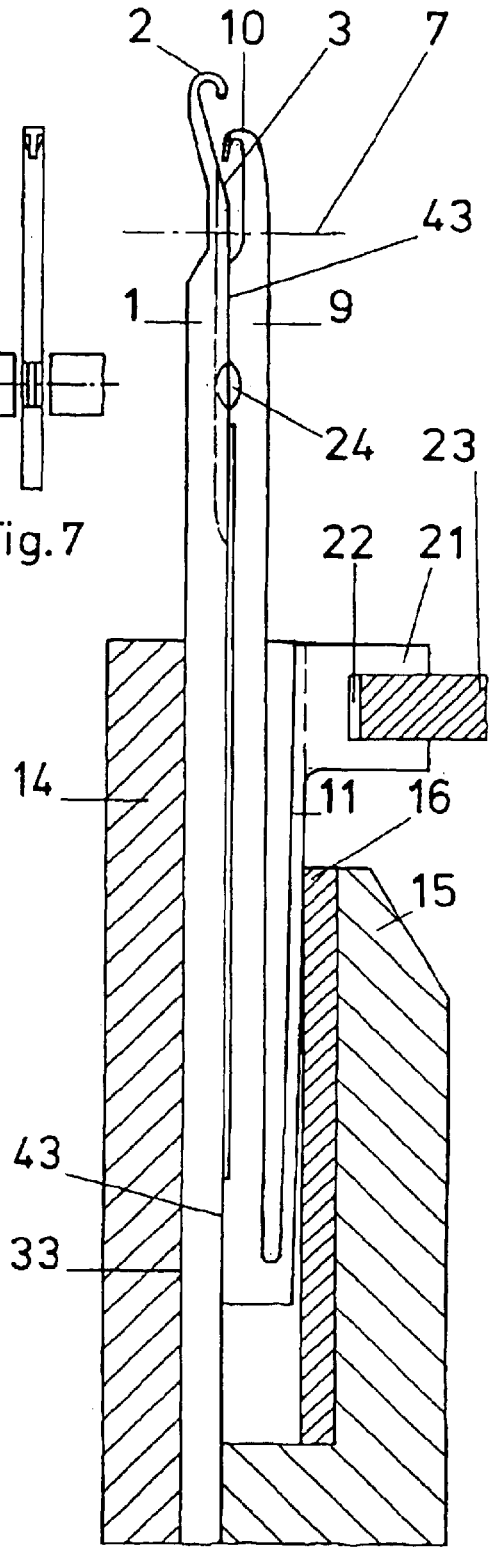
FIG. 8, an embodiment for warp knitting machines without transverse motion of the transfer hook.
Figure 11:
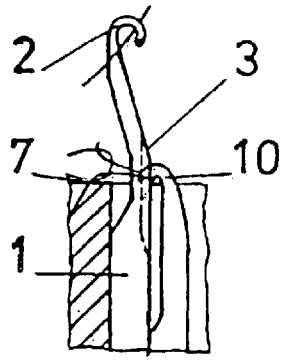
FIGS. 11–14, the course of forming one loop shown in partly cutaway form through a needle channel in the upper part of a needle cylinder with the versions of FIGS. 5 and 8 as well as of FIGS. 15–17.

FIG. 8 shows the advantageous use of the apparatus of FIG. 5 for warp knitting machines. In those machines, compound needles have become the well-established. The needles and closing elements are not moved individually but rather in rows, in what are called bars. The needles and closing elements each need one especially controlled bar. Both the needles 1, 2, 3 and the shank 9 of the transfer hook 10 can be received in only a single bar. The tentering pad 15 presses the needle 1, 2, 3, in the rear zone, against the channel bottom 33. There, the channels are offset to the height of the needle shank 1, while in the front part a slide face 16 is provided, below which the spring part 11 of the shank 9 of the transfer hook 10 makes the requisite small relative motion of the transfer hook 10 with respect to the needle hook 2 possible. The spring part 11 changes over into an outward-oriented extension 21 with a channel 22, which is engaged by the control ruler 23 for the relative motion of the needle 2 with respect to the transfer hook 10. A version without a spring part 11, that is, with a solid rear portion of the shank 9 of the transfer hook 10, is also possible. The precise contact of the transfer hook shank 9 against the needle 1 can then be effected by means of a spring extension (not shown) formed onto the slide face 16 and extending past the upper edge of the tentering pad 15.

The recess on the back below the needle hook 2, shown in FIGS. 5 and 8, can also be appropriate in the version of the apparatus of FIGS. 1–4.

The slide face 16 can comprise a hardened, polished steel strip that is in addition provided with a titanium nitride coating. Ceramic or cermet embodiments are also possible, as are abrasion-proof plastic surfaces.

Figure 9:
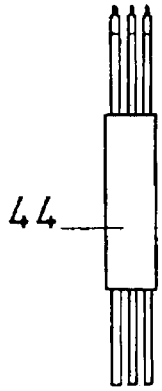
FIGS. 9 and 10, a set of loop forming elements.
Figure 10:
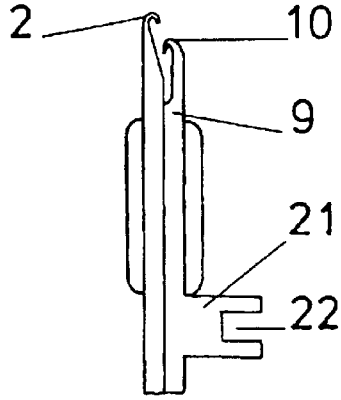

As shown in FIGS. 9 and 10, three elements, each comprising a needle 1, 2, 3 and a transfer hook 9, 10, form a set that makes it possible simultaneously to use three elements, in the present case, side by side in one bar. The elements are supported in a foil 44 with stamped-out features at precisely the spacing corresponding to their working position in the bar. After the elements have been inserted, the foil 44 is removed and discarded. If needed, more than three elements can also be combined into one set.

In the further exemplary embodiment of FIGS. 11–19, no transverse motion of the transfer hook 10 takes place. The transfer hook 10 has caught the last loop, located on the needle cheek 3*a*, above the casting off edge 7, and a new yarn is introduced into the needle hook 2.

Figure 12:
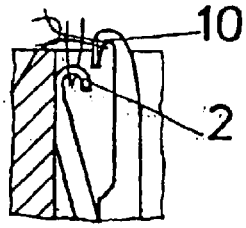

FIG. 12 shows the position of the needle hook 2 for drawing the new loop through the old loop, with the yarn formed into a new loop, while the transfer hook 10 remains in its lower position.

Figure 13:
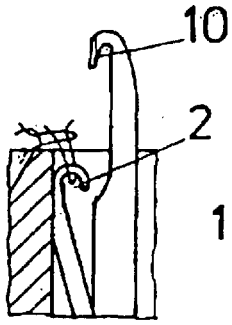

In FIG. 13, the transfer hook 10 has moved upward. The old loop has been cast off over the needle head in the process, so that a new loop has been created in the needle hook 2.

Figure 14:
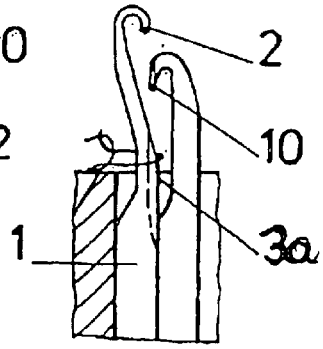

In FIG. 14, the needle 1, 2, 3 has been moved outward and upward again, so that the new loop arrives on the needle cheek 3*a*. This figure also makes the structural relationship of the needle hook 2, needle cheek 3*a* and transfer hook 10 with one another visible; that is, the needle hook 2 is shifted downward, that is, to the left in the side view, to the same extent as the transfer hook 10 has penetrated into the needle cheek 3*a*.

Figure 15:
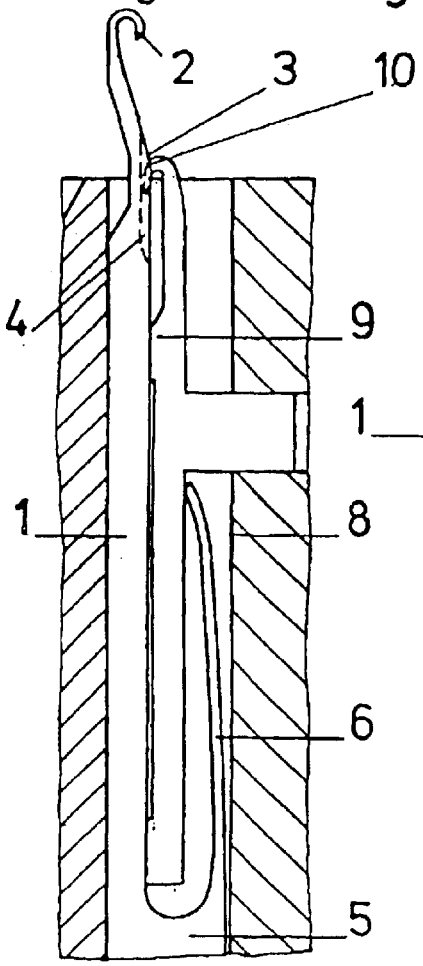
FIG. 15, the support of the transfer hook shank inside the middle part of the needle shank.

FIG. 15 shows how the shank 9 of the transfer hook 10 is received in the middle region 5 of the needle shank 1. For this purpose, the shank of the needle 1 is split there; the lower section (on the left in the side view) merges with the needle cheek 3*a* and the needle hook 2, while the upper part (on the right in the side view) is embodied as a spring part 6. The spring part 6 presses the shank 9 of the transfer hook 10 onto the upper edge of the needle shank 1 without any tolerance, so that a slight projection of the transfer hook 10 below the shank support assures with certainty that the transfer hook in the channel 4 in the needle cheek 3*a*, will grasp the loop located above them.

Figure 16:
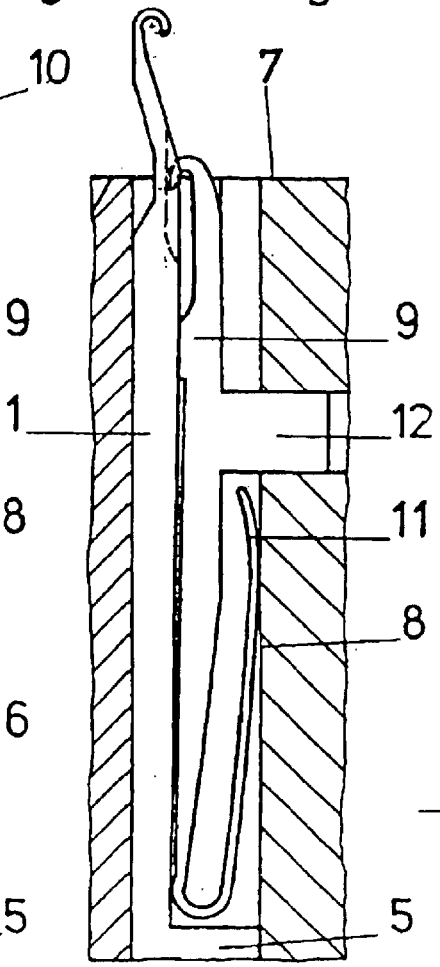
FIG. 16, the transfer hook part with the knitting-needlelike spring part disposed in the rear part of the shank.

The version of FIG. 16 is especially advantageous. Here, the shank 9 of the transfer hook 10 is guided in the needle channel with the full shank thickness of the needle 1, 2, 3. Below its control butt 12, the transfer hook 10 has a spring part 11 that is similar to a knitting needle, so that after the needle cam has been mounted, the inside face 8 of the cam presses the shank 9 of the transfer hook 10 against the needle shank 1 and presses the latter against the needle channel bottom. The control butt provided in the rear region of the needle shank 1, which is guided in a second cam track, is not shown.

Figure 17:
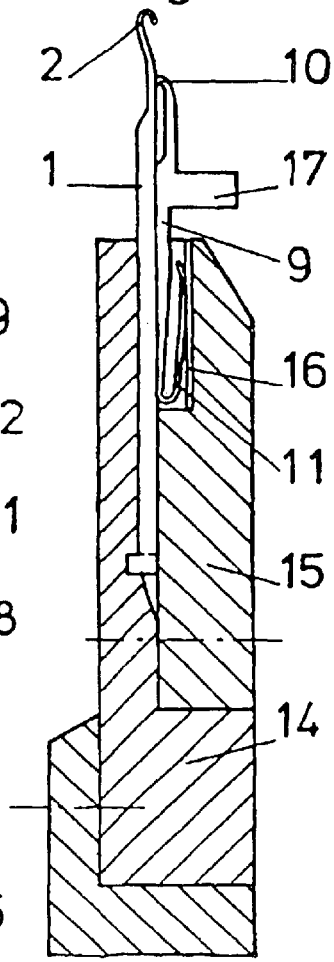
FIG. 17, an application in accordance with FIG. 16 for warp knitting machines.

FIG. 17 shows the advantageous use of the apparatus of FIG. 16 for warp knitting machines. In those machines, compound needles have become well-established. The needles and closing elements are not moved individually but rather in rows—in what are called bars. The needles and closing elements each need one especially controlled bar. Both the needles 1, 2, 3 and the transfer hook parts, the shank 9, can be received in only a single bar 14. The tentering pad 15 presses the needle 1, 2, 3, in the rear zone, against the channel bottom, while in the front part a slide face 16 is provided, below which the spring region 11 of the transfer hook parts 9 makes the requisite small relative motion of the transfer hook 10 with respect to the needle hook 2 possible. This purpose is served by the control butt 17, which for instance with a channel ruler, not shown, encompasses and controls the transfer hook feet. A version without a spring part 11, that is, with a solid rear portion of the shank 9 of the transfer hook 10, is also possible.

Figure 18:
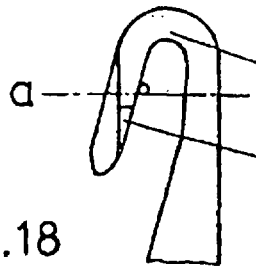
FIGS. 18 and 19, the transfer hook, greatly enlarged, with lateral widening of the loop to the thickness of the needle.
Figure 19:
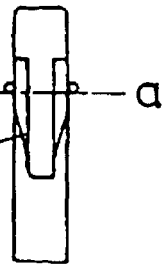

FIGS. 18 and 19 are highly enlarged views of the transfer hook 10 with the lateral offsets for introduction into the needle groove 4 (FIG. 15). The zone that is weakened there serves only to grasp the loop, which upon further downward motion of the transfer hook 10, which is embodied somewhat obliquely to the needle hook 2, up to the indicated knockover edge a—a (7 in FIG. 11) is widened outward via the rising slide rail 18, to the full shank thickness and can thus absorb a major tensile stress on the yarn.

In FIG. 20, in the needle channel in the upper part of the needle cylinder 1*a*, the needles 1 are moved in the vertical direction, with a rear control butt (31 in FIG. 29) that is not visible in this enlarged view, in a known manner with a cam track provided there. The bearing part, also not visible, fixed longitudinally in the channel walls is located on the upper edge of the needle and opens at the top into a flat spring 26, where there is a lug 29, as a bearing point 27, which is engaged by the channel 28 of the lever 13 with the transfer hook 10. The flat spring 26 has an outward oriented initial tension and presses the control knob 12 into the control track 20, 20*a*, 20*b* (FIGS. 20 and 22) located at the top of the cam 19, so as to move the transfer hook 10 pivotably, both radially and vertically.

The flat part 5 of the needle 1 located below the needle hook 2 has a slot. 4 (FIGS. 20–22), which the transfer hook 10, shown in its basic position, can penetrate. The transfer hook 10 retrieves whatever is the last loop of the needle 1 that has been advanced (that is, moved upward) from the slot 4 of the flat part 5. FIG. 1 shows the plan view on the corresponding part of the needle 1 having the slot 4.

In this version, the transfer hook 10 cannot have the full needle thickness in the region of engagement with the flat part 5. In the case of fine needles, it is therefore advantageous for the needle 1 to be widened somewhat in the region of the slot 4, so that the stablest possible transfer hook 10 can be used.

FIG. 22 shows the plunging motion of the transfer hook 10 into the needle slot 4. The flat part 5 is offset somewhat from the needle bottom; to enable a deflection in the event that some malfunction prevents or hinders the transfer hook 10 from pivoting into the slot 4. Because of the initial stress of the flat spring 26, the control knob 12 of the lever 13 is pressed against the vertical control track 20; that is, the pivoting of the transfer hook 10 into and out of the slot 4 of the needle 1 is accomplished by the control tracks 20*a* and 20*b*.

FIGS. 23–28 show the loop formation. The old loop is grasped by the transfer hook 10 in the tuck position of the needle.

Figure 29:
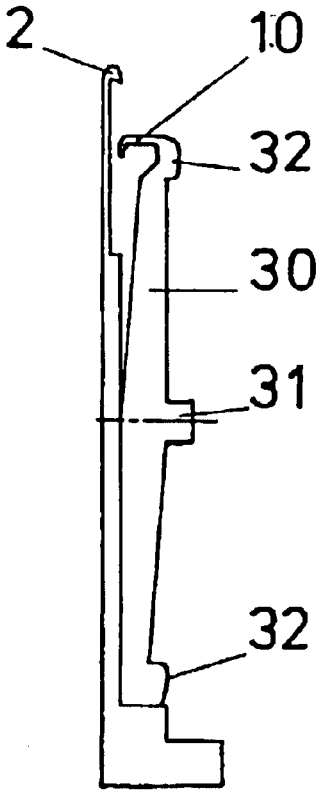
FIGS. 29–31, further versions of the transfer hook part.

FIG. 29 shows a further embodiment for controlling the transfer hook 10. The transfer hook here is located on a rocker element 30, inserted above the shank of the needle 1, that for the motion in the longitudinal direction has a foot 31 and for the transverse motion has raised areas 32 on both ends, which protrude in alternation and are moved in alternation by the raised profile areas in the needle cam (the latter not shown). The loop formation is as described for FIGS. 23–28.

Figure 30:
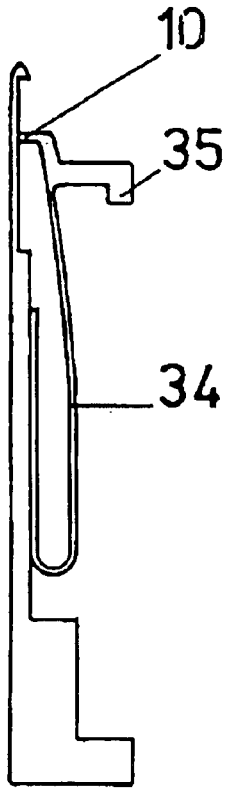

FIG. 30 shows an especially advantageous embodiment for the motion of the transfer hook 10, with which both its longitudinal motion and its transverse motion are possible with a single control point. This purpose is served by a closing element 34 bent in the shape of a hairpin, which under spring action plunges into the needle slot 4 (FIGS. 20, 22) and which has a tooth 35, disposed to the rear of the transfer hook 10, that is controlled in the cam track (not shown). To enable executing the transverse motion of the transfer hook 10, the control track (not shown) must have a control track (not shown) that engages the tooth 35 from behind.

Figure 31:
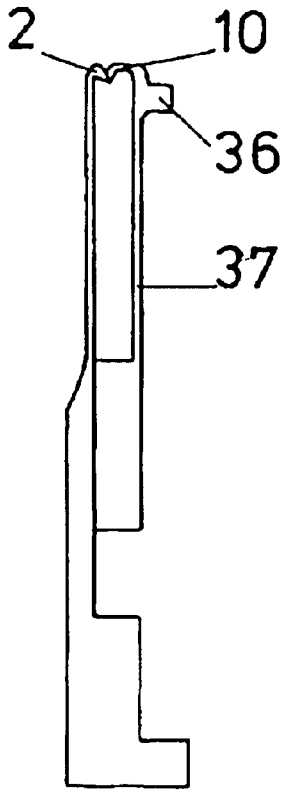

FIG. 31 also shows an advantageous design of the loop-forming parts. Here, from a solid part that is displaceable via the needle shank, the closing element 37 merges upward with a resilient part, on whose end the control cam 36 points in the opposite direction from the transfer hook 10. The longitudinal motion and the transverse motion can be executed at the same point via the small control cam 36.

The examples described are applications for high-performance circular knitting machines. The loop formation described can also be achieved in a dial (not shown), disposed perpendicular to the cam cylinder 1*a*, for producing double-faced knitted goods. In principle, still other loop formations can also be achieved with the invention, for instance in flat knitting machines or links-links machines. The described method can also be used advantageously for warp and weft knitting machines. In them, compound needles have become well-established, but with fine pitches, they have the disadvantages described. In them, the loop-forming elements, that is, needles and transfer hooks, are fastened in so-called bars at pitch spacings that depend on the fineness of the knitted goods. They are thus moved not individually but rather in rows. The needle bar is secured to a bar carrier which is movable with short strokes under machine control. The loop formation according to FIGS. 11-14 is also suitable for these machines.

What is claimed is:

1. A device for machine knitting with at least one continuous yarn, in which the yarn, by a hook part of a knitting needle, is passed in a loop through a previously formed loop and forms a new loop, in which the knitting needle (1, 2), below a needle hook (2), has a slot (4) into which a downward-oriented transfer hook movable in a vertical direction can be introduced, characterized in that the transfer hook (10) is introducable in to the slot (4) by a simultaneously controllable transverse motion.

2. The device of claim 1, characterized in that then front bearing face (43) of the transfer hook (10), in the upward motion of the transfer hook relative to the needle hook (2), is movable away perpendicular to the needle hook (2) by a depth of a region of a transfer hook (10) engaging the slot (4, 4*a*) by a concavity formed as cheek 3*a* and provided on the needle (1), and that the inward motion of the transfer hook (10) is effected under spring action (6, 1) or via the rear, solid part of the shank (9), by means of a spring part protruding past a tentering pad (15).

3. The device of claim 1, characterized in that a length of the cheek (3*a*) that includes the slot (4) is shorter than a spacing between the transfer hook (10) and an upper edge of its bearing face (43), and that an inward motion of the transfer hook (10) is effected by a slide rail (42) provided on a needle cam.

4. The device of claim 1, characterized in that the transfer hook (10), for introduction into the slot (4), has lateral offsets, which in the form of rising slide rails (18) lead to a full shank thickness of a transfer hook part (9), and/or a shank (9) of the transfer hook (10) has a latch (24), which can be guided in the elongated slot (4) of the knitting needle (1, 2) and is formed by a limited thinning of the shank (9) of the transfer hook (10).

5. The device of claim 1, characterized in that on a back (45) of the transfer hook (10) and/or instead of the slot (4) of the needle (1), a noucat-like concavity (48, 4*a*), which laterally enlarges the edges of noucat beyond a shank thickness.

6. The device of claim 1, characterized in that a shank (9) of the transfer hook (10), or a shank of the needle (1), has a split-off spring part (6, 11), by which the shank (9) of the transfer hook (10) can be pressed against the needle shank (1), and that below or above a split-off of a spring part (6, 11), a control butt (12) is disposed, or the spring part (11) changes over above the split off to an extension (21) that contains a channel (22).

7. The device of claim 1, characterized by a retention foil (44) that includes a plurality of loop-forming elements and fixes them in their position corresponding to a working position.

8. A device for machine knitting with at least one continuous yarn, in which the yarn, by a hook part of a knitting needle, is passed in a loop through a previously formed loop and forms a new loop, in which the knitting needle (1, 2), below a needle hook (2), has a slot (4) into which a downward-oriented transfer hook movable in a vertical direction can be introduced, characterized in that the transfer hook (10) forms an end of a displaceable lever (13), whose other end is embodied as a control butt (12), and whose bearing point (27) comprises a lug (29) that receives a groove (28) of a lever (13), and by a flat spring (26) presses a control butt (12) outward into a control track (20*a*, 20*b*).

9. The device of claim 8, characterized in that the transfer hook (10) is disposed on an upper end of a rocker element (31, 32) that is displaceable vertically in a needle channel and can be inserted into the needle region (5) above the needle (1), a tilting motion of which rocker element is effected by terminal control cams (32) and its longitudinal motion by means of a control butt (31) mounted in the middle and allowing a tilting, or in a middle region (5) of a shank of the needle (1), a hairpin-shaped spring closing element (34) is disposed above it, which has a control tooth (35), remote from the transfer hook (10) and oriented downward, or is disposed on the upper end of a longitudinally displaceable closing element (37), which can be inserted above the shank of the needle (1), which closing element has a control cam (36) remote from the transfer hook (10).

10. The device of claim 1, characterized in that loop-forming elements (needles (1)) and the corresponding transfer hooks (10) are each fastened in bars, and that bar carriers are movable in rows.

11. The device of claim 1, characterized in that the shank (9) of the transfer hook (10) or the shank of the needle (1).

12. The device of claim 1, characterized in that a spring part (6) is formed on the shank of the needle and presses the shank (9) of the transfer hook (10) or slide rail (42) onto in upper edge of the needle shank (1) without any tolerance.

* * * * *